US007224307B2

(12) United States Patent
Hisatsune et al.

(10) Patent No.: US 7,224,307 B2
(45) Date of Patent: May 29, 2007

(54) ELECTRONIC DEVICE

(75) Inventors: Toshiyuki Hisatsune, Tokyo (JP); Tsutomu Yamaguchi, Tokyo (JP); Hirokazu Okabe, Tokyo (JP); Yutaka Sato, Tokyo (JP)

(73) Assignee: Sony Corporation (JP)

( * ) Notice: Subject to any disclaimer, the term of this patent is extended or adjusted under 35 U.S.C. 154(b) by 305 days.

(21) Appl. No.: 10/204,867

(22) PCT Filed: Dec. 25, 2001

(86) PCT No.: PCT/JP01/11380

§ 371 (c)(1),
(2), (4) Date: Dec. 2, 2002

(87) PCT Pub. No.: WO02/052594

PCT Pub. Date: Jul. 4, 2002

(65) Prior Publication Data

US 2003/0137338 A1 Jul. 24, 2003

(30) Foreign Application Priority Data

Dec. 25, 2000 (JP) ..... 2000-392876

(51) Int. Cl.
*G08C 17/00* (2006.01)

(52) U.S. Cl. ..... 341/176; 340/825.69

(58) Field of Classification Search ..... 341/176, 341/22, 23, 31, 13; 340/825.24, 825.25, 340/825.69; 345/169, 158, 168
See application file for complete search history.

(56) References Cited

U.S. PATENT DOCUMENTS 4,617,461 A * 10/1986 Subbarao et al. ..... 250/229
5,477,430 A 12/1995 LaRose
5,655,826 A 8/1997 Kouno et al.
5,705,997 A * 1/1998 Park ..... 340/825.49
5,929,401 A * 7/1999 Flegeo et al. ..... 200/5 A
6,157,323 A * 12/2000 Tso et al. ..... 341/22
6,437,836 B1 * 8/2002 Huang et al. ..... 348/734
6,467,924 B2 * 10/2002 Shipman ..... 362/600
6,507,306 B1 * 1/2003 Griesau et al. ..... 341/176

FOREIGN PATENT DOCUMENTS

| | | |
|---|---|---|
| DE | 297 09 407 | 8/1997 |
| JP | 04-12057 | 1/1992 |
| JP | 7-39153 | 7/1995 |
| JP | 8-273474 | 10/1996 |

* cited by examiner

*Primary Examiner*—Wendy R. Garber
*Assistant Examiner*—Hung Q Dang
(74) *Attorney, Agent, or Firm*—Lerner, David, Littenberg, Krumholz & Mentlik, LLP

(57) ABSTRACT

Electronic equipment includes an operation mechanism having a plurality of key buttons for inputting operations into the device by the user and a base member connecting the plurality of key buttons, both formed of a luminescent material, and a panel placed above the operation mechanism that is formed from a member which can transmit light emitted by the operation mechanism. A plurality of holes are provided to enable operation of the plurality of key buttons and to enable the user to judge the positions and functions of the key buttons for operation even in darkness.

6 Claims, 6 Drawing Sheets

ELECTRONIC DEVICE

TECHNICAL FIELD

This invention relates to an electronic device suitable for being applied to remote control devices, portable telephones, radio receiver units, and the like.

BACKGROUND ART

There have been proposed remote control devices for television receivers in which the key buttons have been designed to be luminescent, in order that the positions of the key buttons for operation can be judged even in darkness.

While a luminescent design for these key buttons has enabled the user to judge the positions of the key buttons, it has not been possible for the user to judge the functions of the key buttons.

DISCLOSURE OF THE INVENTION

In light of this, an object of the present invention is to enable the user to judge the positions and functions of key buttons for operation, even in darkness.

In electronic equipment including a plurality of operation elements, an electronic device of this invention comprises: operation means, in which the plurality of operation elements are integrally formed with a base member which emits light through the release of stored optical energy; switching means, which puts a circuit of the electronic equipment into a closed state or an open state accompanied by depression of an operation element; and cover means, comprising holes corresponding to each of the operation elements for the purpose of depressing the operation elements, and which transmits at least part of the light emitted by the operation means.

According to this invention, since a plurality of operation elements and a base member which emits light through the release of stored optical energy are formed integrally, the entirety of this operation means emits light, the emitted light is transmitted through the transmissive cover means, and the transmission of light being through this cover means, thereby enables the user to judge the positions and functions of the operation elements for operation, even in darkness.

BEST MODE FOR CARRYING OUT THE INVENTION

Figure 1:
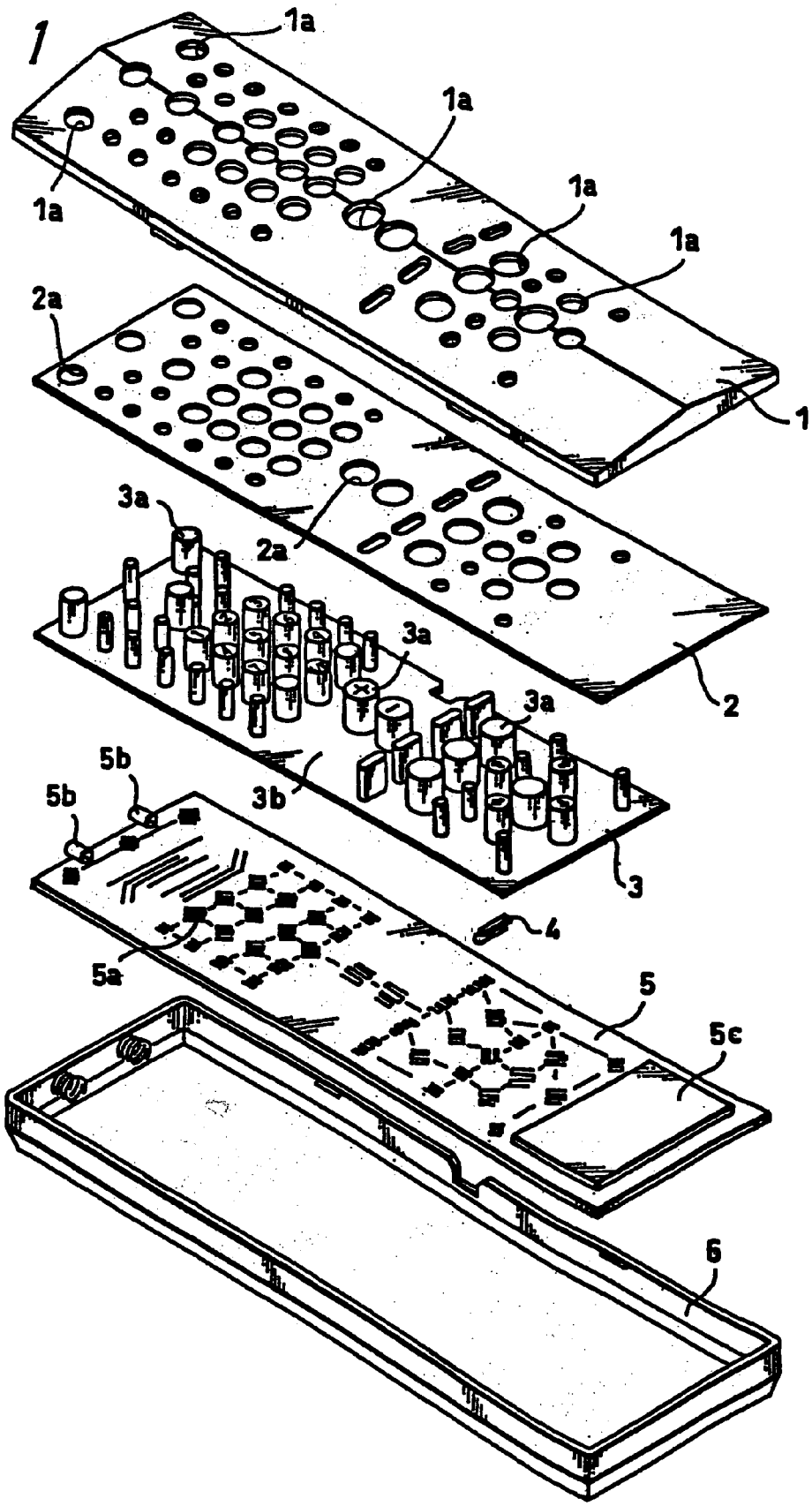
FIG. 1 is an exploded perspective view showing an embodiment of a remote control device according to the invention.

Referring to the drawings, hereinafter, embodiments of the electronic device according to the present invention will be explained.

Figure 2:
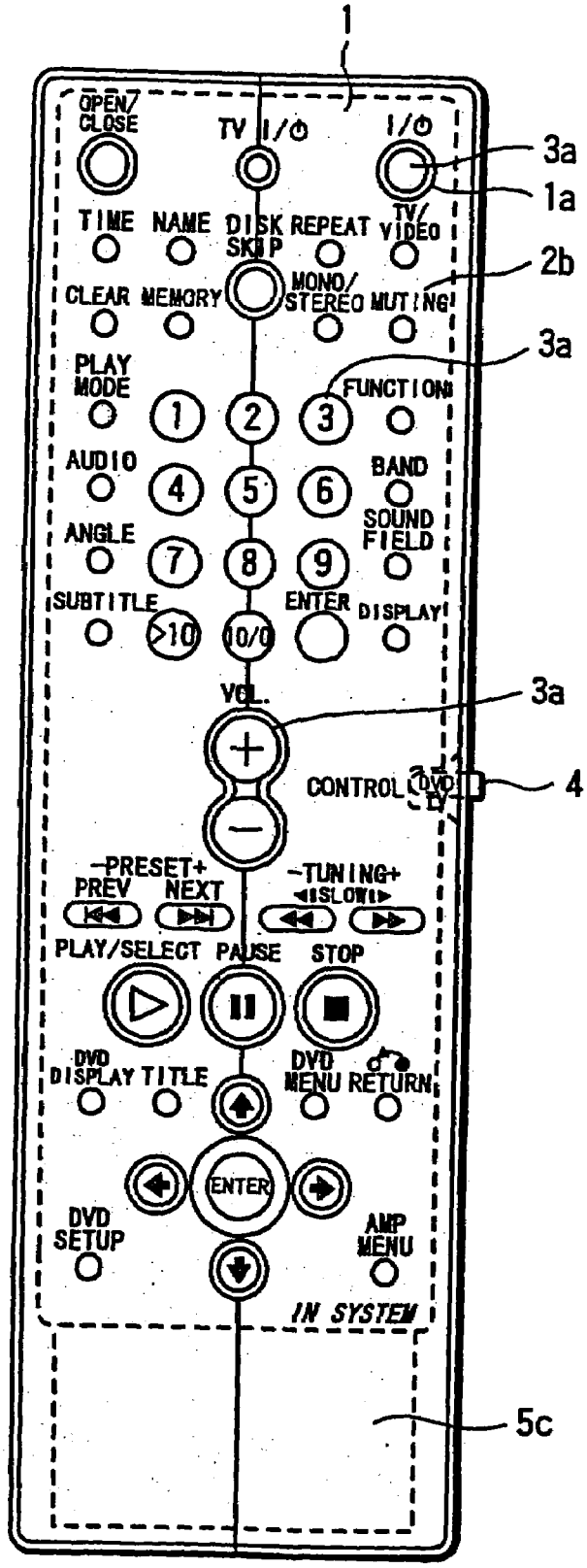
FIG. 2 is a top view of the embodiment in FIG. 1.

FIGS. 1 through 5 are diagrams showing an embodiment in which this invention is applied to a remote control device of a television receiver or the like. FIG. 2 is a top plan view seen from above the remote control device of this embodiment; as shown in FIG. 1, the remote control device of this embodiment comprises an upper panel 1, a semitransparent sheet 2, an operation structure 3 comprising a plurality of key buttons 3*a*, 3*a*, . . . and a base member 3*b*, a switching button 4, a circuit board 5, and a lower case 6.

As shown in FIGS. 1 and 2, this lower case 6 is a rectangular container formed of a synthetic resin, into which the rectangular semitransparent sheet 2, operation structure 3, and circuit substrate 5 are inserted. The upper panel 1 serves as a lid for the lower case 6 of a rectangular box, and is formed from, for example, transparent acrylic which transmits light; a plurality of holes 1*a*, 1*a*, . . . are formed in the upper panel 1, and through which the plurality of key buttons 3*a*, 3*a*, . . . are penetrated, so that the user can operate the plurality of key buttons 3*a*, 3*a*.

On a rectangular printed circuit board of this circuit board 5, circuit elements for remotely controlling a television receiver and DVD player, for example, and a plurality of connection contacts 5*a*, 5*a*, . . . , each short-circuited to the plurality of key buttons 3*a*, 3*a*, . . . , are mounted and further an infrared light-emitting diode 5*b*, photoelectric conversion element 5*c* for supplying power, and the like, are provided at predetermined positions. The switching button 4, which switches functions between that of a remote control device for a television receiver and that of a remote control device for a DVD player, is provided at a predetermined position.

The operation structure 3 comprises the plurality of key buttons 3*a*, 3*a*, . . . for inputting operations of a television receiver or DVD player by the user, and the connecting base member 3*b* formed integrally with this plurality of key buttons 3*a*, 3*a*, . . . , using silicon rubber, for example, in a manner similar to the prior art.

In this embodiment, the silicon rubber or other material forming this operation structure 3 is made to contain a luminescent material, such as, for example, "Picariko" (manufactured by Chemitech Inc.). In this case, the light emission color differs depending on the type of "Picariko" luminescent material; for example, the color is green for "Picariko CP-05", blue for "Picariko CP-10", purple for "Picariko CP-20", and yellow for "Picariko CP-30". It is possible, for example, to use luminescent materials with different light emission colors in the principal key buttons 3*a*, 3*a*, . . . of the operation structure 3.

Figure 3A:
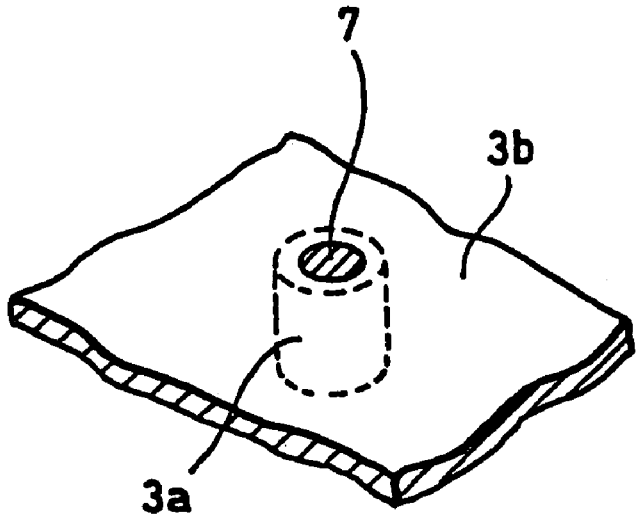
FIG. 3A is a partly enlarged perspective view showing an example of the rear face of an operation structure.
Figure 3B:
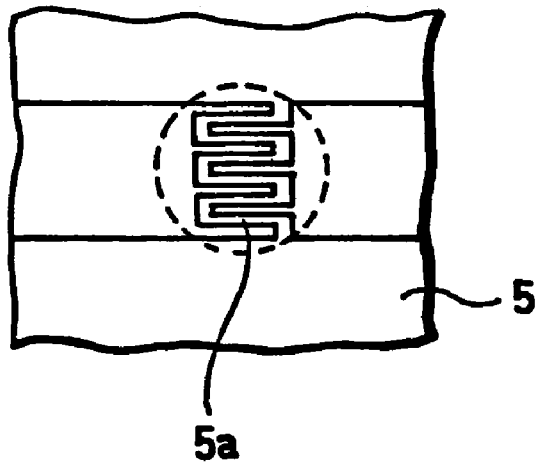
FIG. 3B is a partly enlarged top view showing an example of a connection contact.

In this case, the key buttons 3*a*, 3*a*, . . . are formed in such a manner as to each protrude a predetermined height from the base member 3*b* on the front side of the operation structure 3, as shown in FIG. 1. As shown in FIG. 3A, carbon-impregnated portions 7, which are corresponding to the key buttons 3*a*, 3*a*, . . . , are provided on the rear side of the base member 3*b*, and by means of these carbon-impregnated portions 7, the connection contacts 5*a*, 5*a*, . . . on the circuit board 5 shown in FIG. 3B can be connected to be short-circuited as the key buttons 3*a*, 3*a*, . . . , are pressed downward.

The semitransparent sheet 2 formed with, for example, polycarbonate sheet which transmits light emitted from the base member 3*b*, is positioned between the base member 3*b* of the operation structure 3 and the upper panel 1, and is provided with holes 2*a*, 2*a*, . . . through which the plurality of key buttons 3*a*, 3*a* . . . penetrate. Further, in proximity to these holes 2*a*, 2*a*, . . . , displays 2*b*, for example, indication of the function related to the key buttons 3*a*, 3*a*, . . . which penetrate each hole 2*a*, 2*a* . . . are printed or otherwise displayed.

As shown in FIGS. 1 and 2, the remote control device according to this embodiment is configured such that the circuit board 5 is positioned within the lower case 6, together with the operation structure 3 in a predetermined position with respect to this circuit board 5, with the semitransparent sheet 2 above the operation structure 3 in a way that the key buttons 3*a*, 3*a*, . . . penetrate the holes 2*a*, 2*a*, . . . , with the upper panel 1 fixed in place with the key buttons 3*a*, 3*a*, . . . penetrating the holes 1*a*, 1*a*, . . . , acting as a lid for the lower case 6, and with the switching button 4 installed in a predetermined position.

Figure 4:
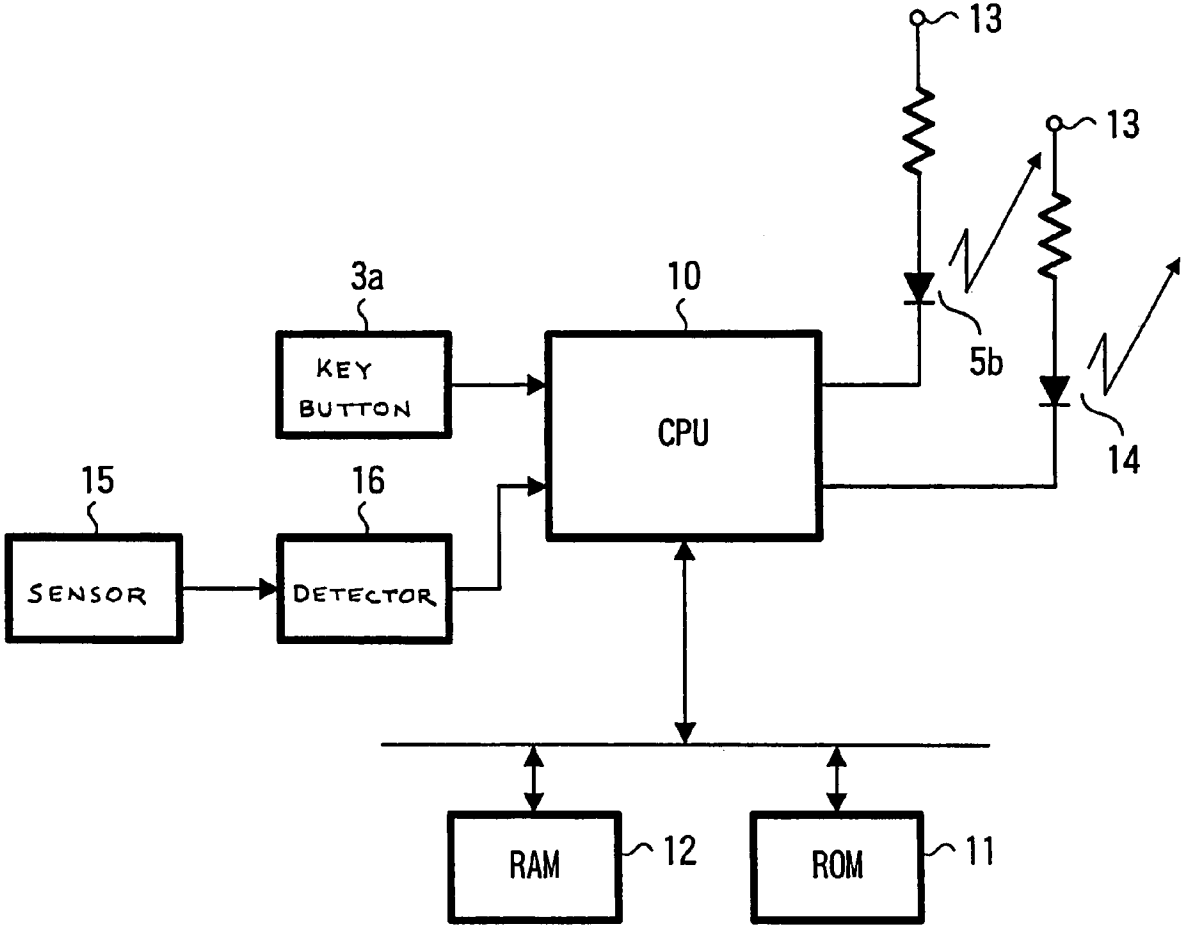
FIG. 4 is a diagram used in explaining this invention.

As shown in FIG. 4, in this remote control device, control signals are supplied to a microcomputer 10 according to the operation of the key buttons 3*a*, 3*a*, . . . by the user; in this microcomputer 10, remote control codes are read from a ROM 11 in which remote control codes corresponding to these control signals are stored in advance, the infrared light-emitting diode 5*b* is caused to emit light according to these remote control codes, and a television receiver, DVD player, or similar is operated remotely.

In FIG. 4, a working RAM 12 is connected to the microcomputer 10 via a bus line, while a predetermined program or similar is stored in the ROM 11, which is connected to the microcomputer 10 via the bus line. In FIG. 4, Numeral 13 denotes power supply terminals.

In this embodiment, as described above, the operation structure 3, in which a plurality of key buttons 3*a*, 3*a*, . . . and a rectangular base member 3*b* connecting this plurality of key buttons 3*a*, 3*a*, . . . are formed integrally, contains a luminescent material; hence the entirety of the operation structure 3 emits light, and this emitted light is transmitted through the semitransparent sheet 2 and upper panel 1, as well as the plurality of key buttons 3*a*, 3*a*, . . . emitting light. Therefore, even in darkness, the positions of the plurality of key buttons 3*a*, 3*a*, . . . , and the displays related to the key buttons 3*a*, 3*a*, . . . , that is, their functions, can be judged.

In this embodiment, displays, for example, printed functions or similar related to the key buttons 3*a*, 3*a*, . . . , are provided on the semitransparent sheet 2; hence the related displays are provided without difficulty, and in addition, when the remote control device is marketed in various countries around the world, it is only necessary to replace the semitransparent sheet 2 with another sheet having displays in the language of the country of use. Also, since the related displays are provided on the semitransparent sheet 2, the displays are not touched during use of the remote control device, so that the printing or similar is not peeled or otherwise removed by rubbing or similar.

Figure 5:
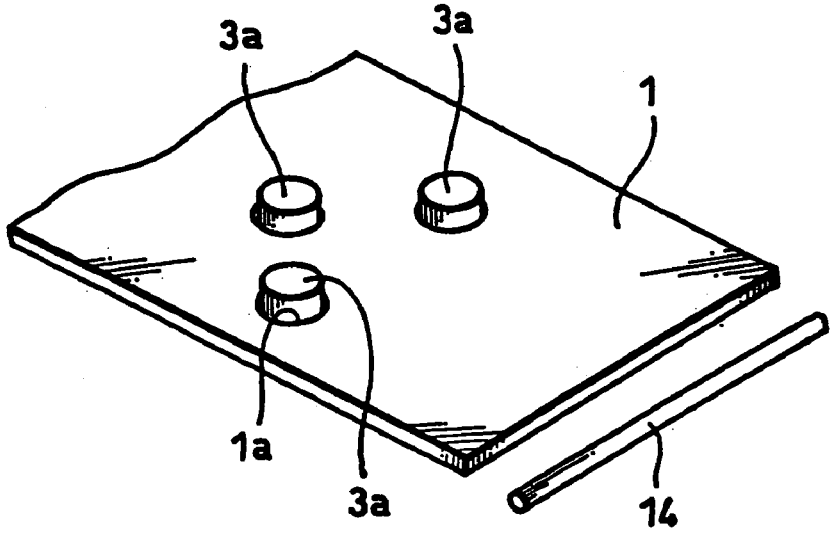
FIG. 5 is a partly enlarged perspective view, used in explaining this invention; and, FIG. 6 is a perspective view showing another embodiment of this invention.

In this embodiment, in order to increase the light stored in the operation structure 3, a light-emitting diode 14 is provided in one side of the upper panel 1 as shown in FIGS. 4 and 5; whether the user is holding the remote control device is detected by means of a sensor 15, such as, for example, an electrostatic capacitance sensor, infrared sensor, or mechanical switch, and the light-emitting diode 14 is then caused to emit light for a predetermined length of time. When the light-emitting diode 14 emits light, light is stored in the luminescent material of the base member 3*b* and key buttons 3*a*, 3*a*, . . . of the operation structure 3.

Specifically, as shown in FIG. 4, the output signal of this sensor 15 is supplied to a detection circuit 16, and when this detection circuit 16 detects that the remote control device is being held by the user, the detected signal is supplied to the microcomputer 10, and the microcomputer 10 causes the light-emitting diode 14 to emit light for a predetermined length of time.

Figure 6:
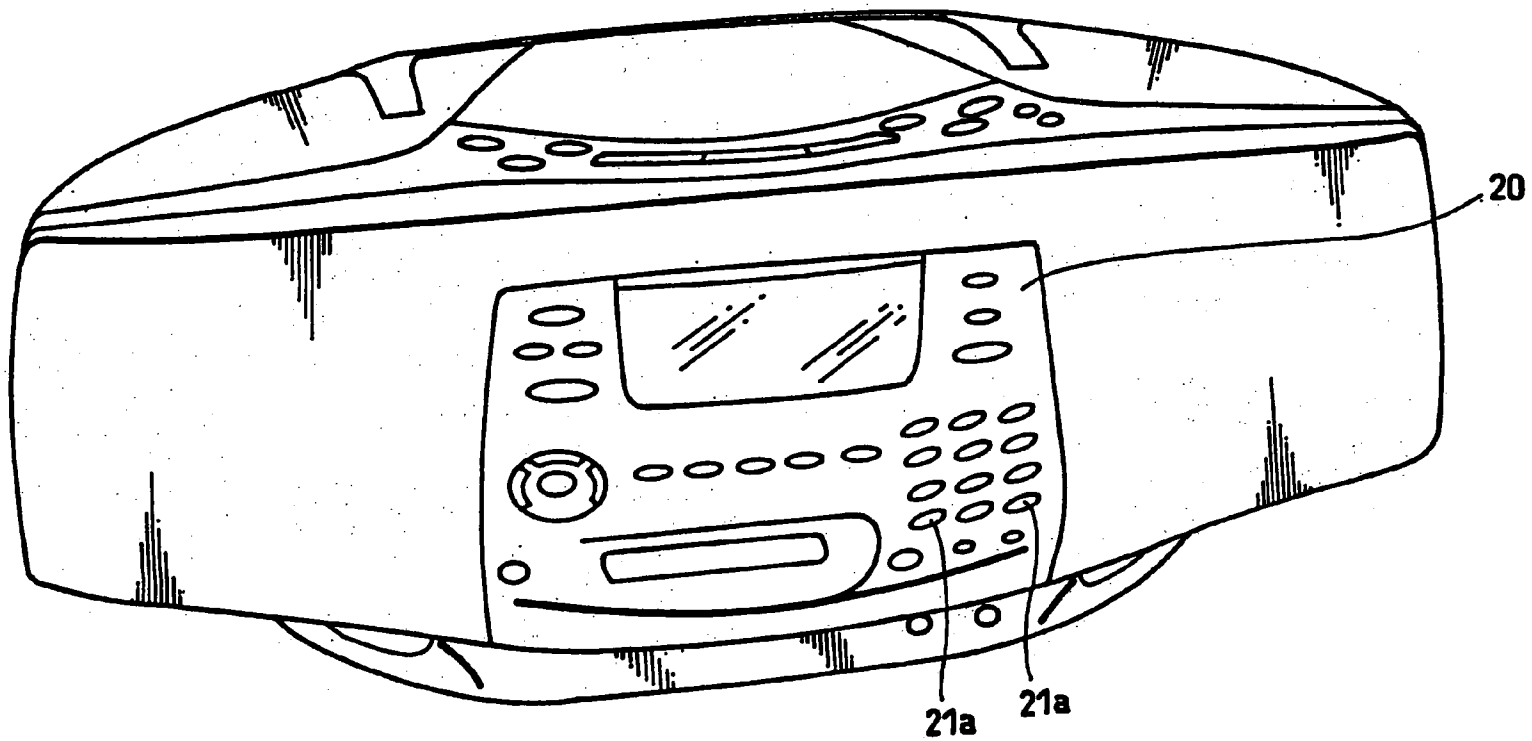

In the above-described embodiment, the case where this invention is applied to a remote control device is described; however as shown in FIG. 6, it is also possible to apply this invention to a radio receiver, portable telephone, or other electronic devices. In FIG. 6, a front panel 20 composed of an light transmission material, and an operation structure, in which a plurality of key buttons 21*a*, 21*a*, . . . as well as a base member connecting the plurality of key buttons 21*a*, 21*a*, . . . are formed integrally, contain luminescent material. Otherwise the configuration is similar to that of FIG. 1.

In the embodiment according to FIG. 6, it is understandable that an advantageous result similar to that of the embodiment shown in FIGS. 1 and 2 is also obtained.

In the above-described embodiments, the displays related to the key buttons 3*a*, 3*a*, . . . are provided on the semitransparent sheet 2; however, the displays related to the key buttons 3*a*, 3*a*, . . . (21*a*, 21*a*, . . . ) may be provided on the upper (front) panel 1 (20), on the side near the base member, without providing the semitransparent sheet 2. Such a configuration can also prevent the disappearance of the displays related to the key buttons 3*a*, 3*a*, . . . (21*a*, 21*a*, . . . ) due to rubbing or similar. Also, in this case the upper panel may be semitransparent rather than transparent, whereby a burr or the like originated in forming of the base member 3*b* is not easily seen, and fluctuation in brightness at different locations on the base member 3*b* are absorbed, so that light is transmitted in such a way that light emission is averaged.

The present invention is not limited to the above-described embodiments, and of course various other configurations may be adopted without deviating from the gist of this invention.

The invention claimed is:

1. Electronic equipment, comprising:

operation means including a plurality of operation elements integrally formed with a base member entirely of a material that emits light through release of stored optical energy;

switching means operable to put circuits of the electronic equipment into one of a closed state and an open state upon a deformation of said base member by a depression of at least one of said plurality of operation elements;

a cover including a plurality of holes for receiving said plurality of operation elements therethrough to thereby permit depressing of said operation elements, said cover transmitting at least part of light emitted by said plurality of operation elements;

a light source operable to emit light; and sensor means for detecting when a user is holding the electronic equipment, wherein when said sensor means detects that a user is holding the electronic equipment, light is emitted by said light source for a predetermined length of time and stored as optical energy in said material forming said operation means.

2. The electronic equipment according to claim 1, wherein said cover includes a plurality of displays related to said plurality of operation elements.

3. The electronic equipment according to claim 2, wherein said plurality of displays are provided on a side of said cover adjacent to said operation means.

4. The electronic equipment according to claim 1, further comprising:

light-transmitting display means provided between said cover and said operation means for transmitting at least a part of the light emitted by said operation means, said light-transmitting display means including a plurality of holes for receiving said plurality of operation elements therethrough to thereby permit depressing of said plurality of operation elements and a display related to said plurality of operation elements.

5. The electronic equipment according to claim 1, further comprising:

light emission control means for controlling emission of light by said light source.

6. The electronic equipment according to claim 1, wherein said switching means causes at least two of said circuits to be conductive in response to depression of at least one of said plurality of operation elements.

* * * * *